US005596803A

United States Patent [19]

Encrenaz

[11] Patent Number: 5,596,803

[45] Date of Patent: Jan. 28, 1997

[54] ELECTRODE FOR ELECTROPHORETIC DEPOSITION

[75] Inventor: Claude Encrenaz, Voiron, France

[73] Assignee: Pechiney Recherche, Courbevoie, France

[21] Appl. No.: 502,944

[22] Filed: Jul. 17, 1995

Related U.S. Application Data

[63] Continuation of Ser. No. 138,252, Oct. 20, 1993, abandoned.

[51] Int. Cl.[6] ..... H01R 43/00; C25D 13/14

[52] U.S. Cl. ..... 29/825; 204/479

[58] Field of Search ..... 204/280, 284, 204/299 EC; 29/825

[56] References Cited

U.S. PATENT DOCUMENTS 2,970,950 2/1961 Bahmann ..... 204/26

FOREIGN PATENT DOCUMENTS 1077212 7/1967 United Kingdom .

*Primary Examiner*—Kathryn Gorgos
*Assistant Examiner*—Kishor Mayekar
*Attorney, Agent, or Firm*—Dennison, Meserole, Pollack & Scheiner

[57] ABSTRACT

An electrode for electrophoretic deposition on an electrically conductive surface is formed with a conductive cylindrical tube or solid cylinder. The invention describes coating only the outer lateral surface with an insulating coating, except for one or more annular zone(s) situated facing the object to be coated. The result obtained is a thin deposit which is as uniform as possible.

3 Claims, 1 Drawing Sheet

ELECTRODE FOR ELECTROPHORETIC DEPOSITION

This is a continuation of application(s) Ser. No. 08/138,252 filed on Oct. 20, 1993, now abandoned.

BACKGROUND OF THE INVENTION

The invention relates to an electrode for electrophoretic deposition on a conductive surface.

It is known that the electrophoretic deposition of material of plastics material, for example a varnish, on metallic objects (or at least electrically conductive objects) is carried out by placing the object in the position of an electrode of a direct current source, the other electrode, connected to the other terminal of the direct current source being suitably shaped, the electrodes being placed in the electrophoresis bath.

The problem to be resolved is that of obtaining a thin deposit, typically of 2 to 20 μm thickness, which is as uniform as possible on the surfaces of the object to be coated.

In the case of objects having an axis of revolution, for example cylindrical in shape, provided with a bottom and required to be coated on their inner face and in accordance with the prior art, a conductive electrode is placed on the axis of revolution of the object and preferably takes the form of a solid cylinder or of a conductive tube of circular cross-section and having the same axis as this latter. However, edge effects result such that the quantities deposited in the vicinity of the edge of the opening in the object are far greater than on the rest of the surface.

SUMMARY OF THE INVENTION

The Inventors have found that in order to obtain a far more uniform thicknesses of deposit, it is sufficient to coat the outer lateral surface of the electrode with an insulating layer and to slit it at one or more places in annular fashion over a width e which may extend up to a few millimeters in order to bare the conductive surface. This or these incision(s) is or are disposed opposite the object to be coated.

The width of each slit is preferably comprised between 0.5 and 3 mm and is in particular around 1 mm.

After tests, it has been found that the more uniformly adjacent an equipotential curve of the applied electrical field the surface to be coated is, the greater the uniformity of the thickness of the coating.

The term uniformly adjacent is understood to mean a substantially constant distance from the axis, comprised between 70 and 90% of the distance to the axis of the surface to be coated.

The result is that precise determination of the position(s) of the slits determined empirically may be made precise by calculation methods to determine equipotential lines, for example for the method of finite elements, in the immediate vicinity of the surface to be coated (the initial surface of the metallic object to be coated represents "by its shape" an equipotential), this surface being a surface of revolution about an axis having a generatrix of any form. Various tests to determine the equipotential lines make it possible to determine the optimum configuration.

The corresponding apparatus is therefore constituted by a solid or tubular cylindrical conductive electrode coated on its outer lateral surface with an insulating coating except for one (or more) annular zone(s) of minimal width in relation to the object to be coated. The width of each annular zone is less than a few millimeters and is preferably comprised between 0.5 and 3 mm and is generally close to 1 mm. Their number is generally less than or equal to 3.

Although the description and the examples are essentially aimed at the use of an electrode according to the invention in an axial position, it is also possible to use the electrode according to the invention in an outer position for external coating of an object which in particular need not have any symmetry of revolution (for example a receptacle of square or rectangular cross-section).

DESCRIPTION OF THE INVENTION

Figure 1:
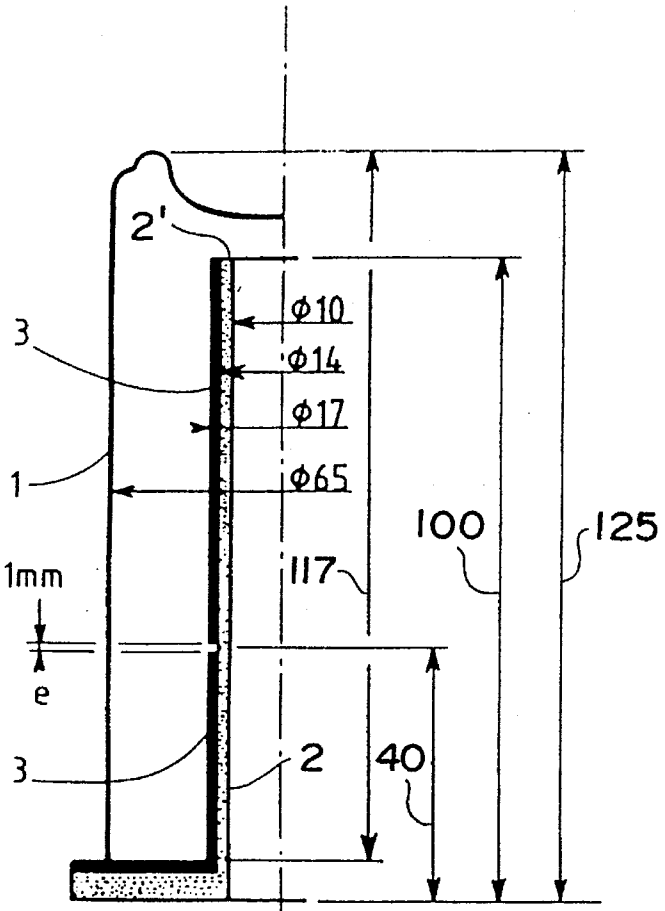
FIG. 1 shows a cross-section one half of a can inside wall and the electrode according to the invention for electrophoric deposition of a resin on the inner wall surface.

FIG. 1 shows the inside wall (1) of a can to be coated. The can is made of Al 3004 alloy (according to the designations laid down by the Aluminum Association).

In a typical application, the inside can diameter is 65 mm, the can height 125 mm. The tubular electrode (2) has an inside diameter 10 mm, outside diameter 14 mm (1.4 times inside diameter) and an effective length, between base and top of 100 mm. The tubular electrode has an outer, lateral surface which is electrically conductive. This surface is covered with an insulating coating (3) consisting preferably of a polymer and 3 mm thickness. As shown in the figures, the electrode top is not coated.

An essential feature is a slit (e) cut in form of an annular zone. A ring of insulating material is removed so as to expose the electrically conductive lateral surface of the electrode. In FIG. 1, the slit is shown as 1 mm wide and located 40 mm from the electrode base.

During the coating process which will be described, an electrical field exists between the electrode and the surface to be coated. By connecting points of equal field strength, an equipotential line or curve can be drawn.

Figure 2:
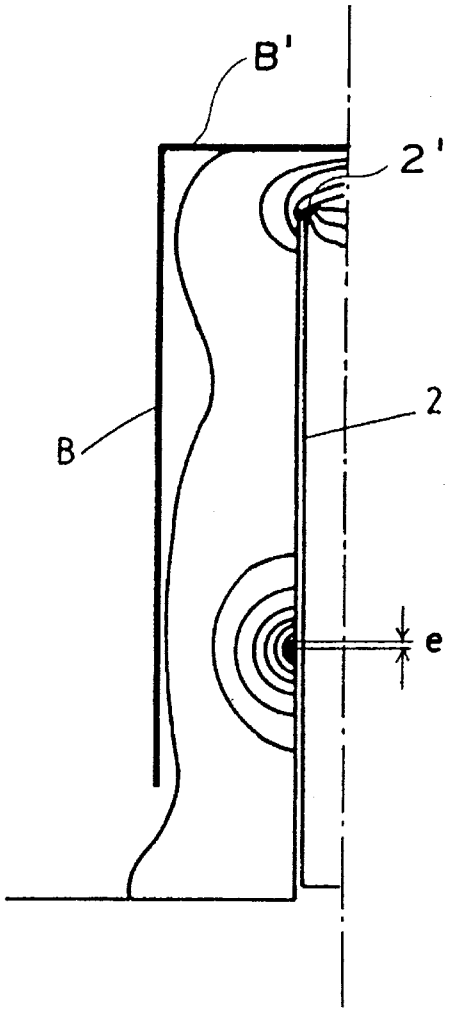
FIG. 2 shows a cross-section of half the electrode, the inner wall surface of a can and a plurality of equipotential curves which connect points of equal strength of the electrical field existing during the coating process, where the electrode of FIG. 1 with one slit is used.

In FIG. 2, a plurality of equipotential curves such as appear to exist between the can inner surface (B) and the coated electrode with one slit, are indicated. The can body is ideally cylindrical with a flat bottom (B'). The distance between the equipotential curves corresponds to 20 V. The location of the slit (e) is determined so that the curve close to the inner surface of the can obtains a shape which closely corresponds to the inner surface.

Figure 3:
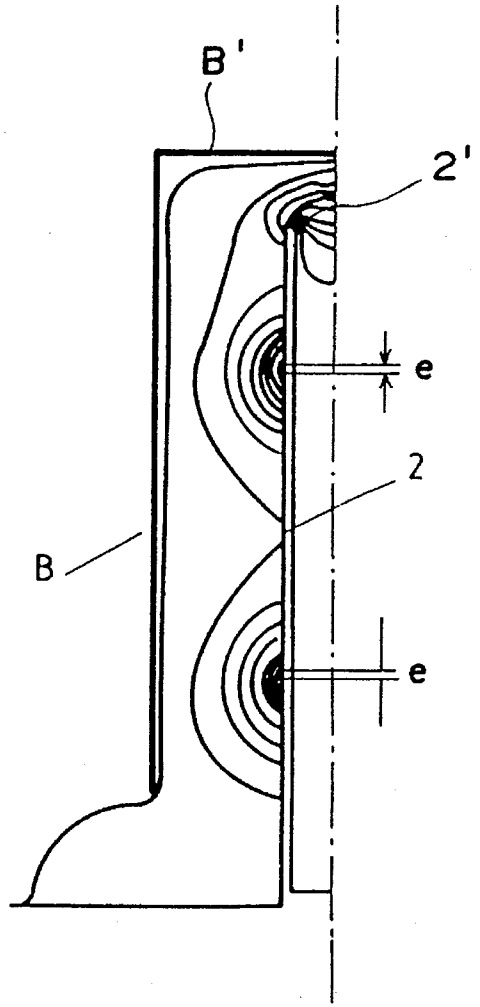
FIG. 3 shows the cross-section and equipotential curves where an electrode with two slits is used.

FIG. 3 shows a plurality of equipotential curves similar to FIG. 2 but with an electrode where two slits have been cut and the coating material has been removed. Comparison of FIG. 3 with FIG. 2 shows a distinct improvement of the desired result, the equipotential curve corresponding substantially to the inner can surface.

Methods to draw or to generate the equipotential lines or curves and methods to determine the optimal location of a slit or of a plurality of slits, are within the skill of the art.

A preferred method is a computer system using software employing the finite element method to determine the position of a slit or slits with respect to the electrode base.

Other methods or tests to determine the equipotential curves make it possible to determine the positioning of the slits.

The deposition conditions were as follows:

The can (1) is connected to the anode (+) of a direct current source of 200 V and the electrode (2) is connected to the other terminal. It is placed in an epoxy-based anaphoretic varnish bath (at the rate of 10 g/l in water, with a pH of 7.7, conductivity 1.76 mS/m and at a temperature maintained at 30° C.), the current is pulsed: 50 ms with current +20 ms without current and treatment lasted 7 seconds.

The results obtained were as follows:

average thickness: 4 μm relative fluctuation: 8%.

The term 'relative fluctuation' in thickness is understood to mean: 100×(maximum thickness–minimum thickness)/mean thickness with $$\text{mean thickness} = \frac{\text{maximum thickness} - \text{minimum thickness}}{2}$$

in which h(x) or $h_n$ is the local thickness.

This electrode with slits in the insulating layer according to the invention finds its application in all cases of electrophoretic coating in which the relative fluctuation in thickness has to be maintained at <10%.

I claim:

1. A method of producing a tubular electrode for electrophoretic deposition of a coating material on a surface of an object comprising the steps of:

covering an outer lateral, electrically conductive surface of the electrode with an insulating coating material;

determining a position with respect to a base of the electrode of one annular zone for exposing the electrically conductive surface of the tubular electrode so that an equipotential curve close to the surface of the object to be coated has a shape which corresponds to said surface;

cutting a slit to form said annular zone, and removing the insulating material along said one annular zone, said electrode producing a substantially uniform layer of coating material on the surface of the object.

2. The method according to claim 1 further comprising the step of determining a position of an additional annular zone for removing insulating material and each of said slit having a width (e) between 0.5 and 3 mm.

3. The method according to claim 2 wherein the width (e) of each of said slit is 1 mm.

* * * * *